US006837450B2

(12) United States Patent
Boecking

(10) Patent No.: US 6,837,450 B2
(45) Date of Patent: Jan. 4, 2005

(54) PRESSURE-AND-STROKE-CONTROLLED INJECTOR FOR FUEL INJECTION SYSTEMS

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 189 days.

(21) Appl. No.: 10/226,153

(22) Filed: Aug. 23, 2002

(65) Prior Publication Data

US 2003/0052187 A1 Mar. 20, 2003

(30) Foreign Application Priority Data

Aug. 23, 2001 (DE) ..... 101 41 221

(51) Int. Cl.[7] ..... F02M 59/00; F02M 39/00; B05B 1/30

(52) U.S. Cl. ..... 239/533.2; 239/533.3; 239/533.8; 239/585.1; 239/585.5; 239/88

(58) Field of Search ..... 239/533.2, 533.3, 239/533.8, 533.9, 88–93, 585.1–585.5; 251/129.15, 129.21

(56) References Cited

U.S. PATENT DOCUMENTS 4,080,942 A * 3/1978 Vincent et al. ..... 123/447
4,129,254 A * 12/1978 Bader et al. ..... 239/96
4,503,825 A * 3/1985 Schneider ..... 123/446
5,884,611 A * 3/1999 Tarr et al. ..... 123/531
5,984,200 A * 11/1999 Augustin ..... 239/88

* cited by examiner

*Primary Examiner*—Davis Hwu
(74) *Attorney, Agent, or Firm*—Ronald E. Greigg

(57) ABSTRACT

An injector for a common rail fuel injection system in which the opening of the nozzle needle is done under pressure control, while the nozzle needle is compulsorily closed when the control valve closes. This has advantages with regard to the onset of injection and the closing of the nozzle needle.

20 Claims, 4 Drawing Sheets

PRESSURE-AND-STROKE-CONTROLLED INJECTOR FOR FUEL INJECTION SYSTEMS

BACKGROUND OF THE INVENTION

1. Field of the Invention

The invention relates to an injector for a fuel injection system for internal combustion engines, having a housing, having a nozzle needle, having a control chamber, and having a pressure chamber, defined by a pressure shoulder of the nozzle needle; the control chamber is defined at least indirectly by the nozzle needle, and the control chamber communicates hydraulically with a fuel inlet via an inlet throttle, and the control chamber can be made to communicate hydraulically by means of a control valve with a fuel return via an outlet throttle.

Injectors of the above type with pressure-controlled or stroke-controlled nozzle needles are known from the prior art.

2. Object and Summary of the Invention

The object of the invention is to further improve an injector for a fuel injection system for internal combustion engines in terms of its injection performance.

According to the invention, this object is attained by an injector for a fuel injection system for internal combustion engines, having a housing, having a nozzle needle, having a control chamber, and having a pressure chamber, defined by a pressure shoulder of the nozzle needle, wherein the control chamber is defined at least indirectly by the nozzle needle, and the control chamber communicates hydraulically with a fuel inlet via an inlet throttle, and wherein the control chamber can be made to communicate hydraulically by means of a control valve with a fuel return via an outlet throttle, in that a 3/2-way valve with a valve member is present; that the 3/2-way valve, in a first switching position, connects the pressure chamber and the fuel return hydraulically to one another; that in a second switching position, the 3/2-way valve connects the pressure chamber and the fuel inlet hydraulically to one another; and that the 3/2-way valve assumes the first or the second switching position as a function of the pressure difference between the fuel inlet and the control chamber.

In the injector of the invention, the nozzle needle opens under pressure control and is compulsorily closed when the pressure in the control chamber increases as a consequence of the closure of the control valve. By these provisions, the opening and closing of the nozzles can be varied independently of one another, within certain limits. Moreover, because of the compulsory closure of the nozzle needle, a rapid closure and suitability of the injector of the invention for performing both preinjections and postinjections as well are obtained.

In a variant of the invention, it is provided that the control chamber is embodied in two parts; that a first part of the control chamber is embodied in the nozzle needle; that a second part of the control chamber is embodied in the valve member; that the first part of the control chamber can be defined by a first shoulder in the housing; and that the second part of the control chamber is defined by a second shoulder in the housing. In this variant, the volume of the control chamber can be kept quite small, because the first part and second part of the control chamber are not triggered simultaneously but instead at staggered times. The result is a further improvement in the opening and in particular the closing performance of the injector of the invention. In a further feature of the invention, it is provided that the second part of the control chamber communicates hydraulically with the fuel inlet via an inlet throttle, and/or that the first part and the second part of the control chamber can be made to communicate with the fuel return, each via a respective outlet throttle, and/or that the first part and the second part of the control chamber communicate hydraulically with one another. In these refinements according to the invention, the volume of the control chamber can be reduced still further, and moreover it is assured that both parts of the control chamber can be supplied with fuel from the fuel return via the inlet throttle.

In a further supplement to the invention, it is provided that the 3/2-way valve has a valve member; that the control chamber is defined by one end face of the valve member; that the fuel inlet can be disconnected from the pressure chamber and/or the leak fuel return by a sealing seat that is embodied in the housing and cooperating with a sealing cone of the valve member; and that the diameter of the sealing seat is less than the diameter of the end face of the valve member.

As a result of the embodiment of the 3/2-way valve with at least one sealing seat, it can be assured that the fuel return and pressure chamber can be disconnected from one another without leakage. Moreover, the valve member, because of the difference in diameter of the sealing seat and the end face of the valve member, can be opened in a simple way as a function of the pressure difference between the fuel inlet and the control chamber.

In another feature of the invention, in the housing, a control edge cooperating with a portion, embodied as a valve piston, of the valve member is provided, and the hydraulic communication between the pressure chamber and the fuel return is controlled via the control edge, so that the advantages of a slide valve come into play in the second switching position of the injector of the invention.

To make production easier, it can be provided that a pressure rod is provided between the control chamber and the nozzle needle; and that the control chamber is defined by a first face end of the pressure rod; and that a second face end of the pressure rod rests on one face end of the nozzle needle. In this embodiment, there is hydraulically no difference from a one-part nozzle needle that directly defines the control chamber. However, it can also be advantageous, as already noted, for reasons of space, production or mounting, to provide a pressure rod between the control chamber and the nozzle needle.

Alternatively, the first part of the control chamber can be disposed in a pressure rod.

In a further feature of the invention, between the housing and the nozzle needle a nozzle spring is provided; and the nozzle spring presses the nozzle needle in the direction of a nozzle needle seat, so that the injector is closed when there is no pressure in the fuel inlet.

In another feature of the invention, between the housing and the valve member, a closing spring is provided, which presses the valve member in the direction of the sealing seat, so that the 3/2-way valve likewise assumes a defined position if the injector is without pressure.

Alternatively, the control valve can be actuated by an electromagnet or a piezoelectric actuator.

To simplify production and assembly, the housing can be embodied in two parts.

By using the injector of the invention in a common rail fuel injection system, the advantages of the invention can be made useful for these fuel injection systems as well.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
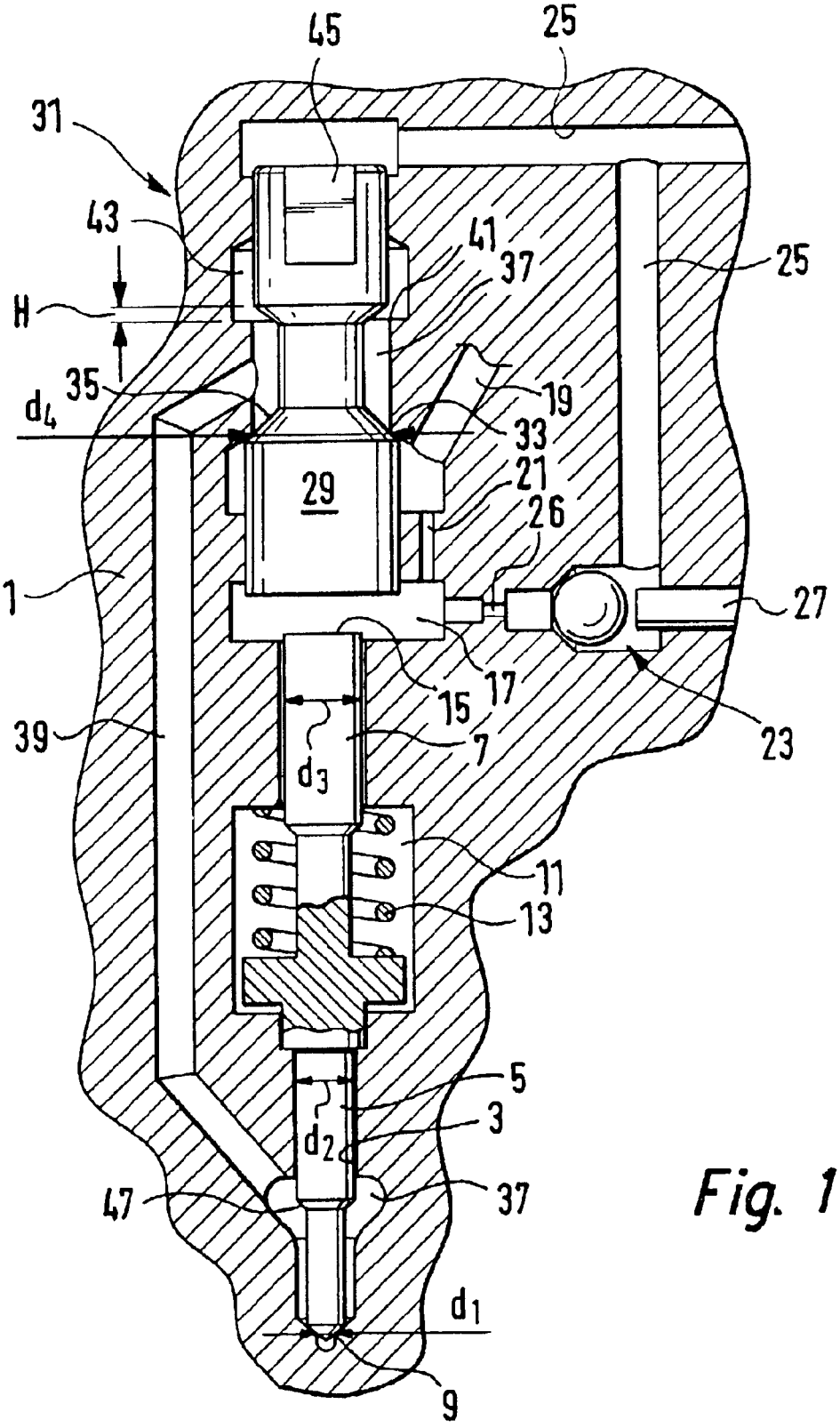
FIG. 1 shows a first exemplary embodiment of an injector of the invention.

In FIG. 1, a first exemplary embodiment of an injector of the invention is shown schematically. The injector has a housing 1, in which there is a stepped bore 3. A nozzle needle 5 and a pressure rod 7 are guided in the stepped bore 3. The stepped bore 3, on the side toward the combustion chamber, ends in a nozzle needle seat 9. The nozzle needle seat 9 has a first diameter $d_1$. The nozzle needle 5 is guided in a portion of the stepped bore 3 that has a second diameter $d_2$. The pressure rod 7 is guided in a portion of the stepped bore 3 that has a third diameter $d_3$. A nozzle spring chamber 11 is recessed out of the housing 1, and in it a nozzle spring 13 is provided, which is braced on one end against the housing 1 and on the other against a shoulder of the pressure rod 7. The nozzle spring 13 assures that the nozzle needle 5 is pressed into the nozzle needle seat 9 when the injector is without pressure.

One face end 15 of the pressure rod 7 protrudes into a control chamber 17. The control chamber 17 is subjected to fuel at high pressure via a fuel inlet 19, which communicates with a common rail, not shown, and via an inlet throttle 21. Via a control valve 23, the control chamber 17 can be made to communicate with a fuel return 25. In the first exemplary embodiment, the control valve 23 is embodied as a ball valve with a final control element 27, which is actuated by an actuator not shown, in particular a magnet valve or a piezoelectric actuator. Alternatively, still other control valves can also be used.

The control chamber 17 is defined, at least in part, by a valve member 29 of a 3/2-way valve 31. The 3/2-way valve 31 is embodied as a seat/slide valve. In the first switching position, shown in FIG. 1, the fuel inlet 19 is disconnected hydraulically from a pressure chamber 37 and the leak fuel return 25 by a sealing seat 33 of the housing 1, which cooperates with a corresponding sealing cone 35 of the valve member 29. The diameter of the sealing seat 33 is indicated in FIG. 1 as the fourth diameter $d_4$. An important factor is that the fourth diameter $d_4$ is less than the diameter of the valve member 29 with which the valve member defines the control chamber 17. Only if this condition is met can an opening of the 3/2-way valve 31 from its first switching position into a second switching position be attained by means of a pressure difference between the fuel inlet 19 and the control chamber 17. The 3/2-way valve 31 communicates with the pressure chamber 37 on the end toward the combustion chamber of the nozzle needle 5 via a connecting bore 39.

Between the control chamber 17 and the control valve 23, an outlet throttle 26 is provided. In the upper region of the 3/2-way valve 31, in terms of FIG. 1, a control edge 41 is embodied in the housing 1; together with the valve member 29, embodied in this region as a control piston, this control edge brings about a hydraulic disconnection between the pressure chamber and the fuel inlet 19 on the one hand and between the pressure chamber and the fuel return 25 on the other. This switching position is called the second switching position, in terms of the invention. To enable the communication between an annular chamber 43, located above the control edge 41, and the fuel return 25 past the valve member 29, flat faces 49 are made in the valve member 29, these faces being distributed uniformly over the circumference of the valve member 29.

If the pressure in the control chamber 17 drops as a result of the opening of the control valve 23, the valve member 29 moves out of the first switching position shown in FIG. 1 and toward the control chamber 17. This motion is tripped by a hydraulic force, which is exerted on the annular face that is defined by the fourth diameter $d_4$ and the diameter of the valve member 29 in the control chamber 17, or by the high pressure of the fuel from the fuel inlet 19 that is exerted on this surface area.

Once the valve member has traveled the distance of a valve stroke H, the valve piston of the valve member 29 begins to cover the control edge 41. This disrupts the communication between the pressure chamber 37 and the fuel return 25.

On the other hand, as soon as the valve member 29 lifts from the sealing seat 33, fuel from the fuel inlet 19 can flow into the pressure chamber 37 via the connecting bore 39. As soon as the fuel under pressure in the pressure chamber 37 exerts a sufficient force on the pressure shoulder 47 of the nozzle needle 5 to overcome the closing force of the nozzle spring 13 and the hydraulic force acting on the end face 15, the nozzle needle 5 opens by lifting from the nozzle needle seat 9. Accordingly, the opening of the nozzle needle 5 takes place under pressure control. However, the pressure chamber 37 is not subjected to fuel that is at high pressure until the valve member has traversed a stroke H and has thus disrupted the communication with the fuel return 25. Because the nozzle needle 5 opens under pressure control, good opening performance of the injector of the invention is assured.

The injector of the invention closes when the control valve 23 is closed and thus when the pressure in the control chamber 17 increases again. As soon as the hydraulic force acting on the end face 15 of the pressure rod 7 is greater than the hydraulic force acting on the pressure shoulder 47 of the nozzle needle, the nozzle needle 5 closes again, and the injection is terminated. The nozzle needle 5 thus closes under compulsory control. This assures a rapid closure of the nozzle needle at all operating points. A postinjection is also possible as a result of the described compulsory closure of the nozzle needle 5.

Figure 2:
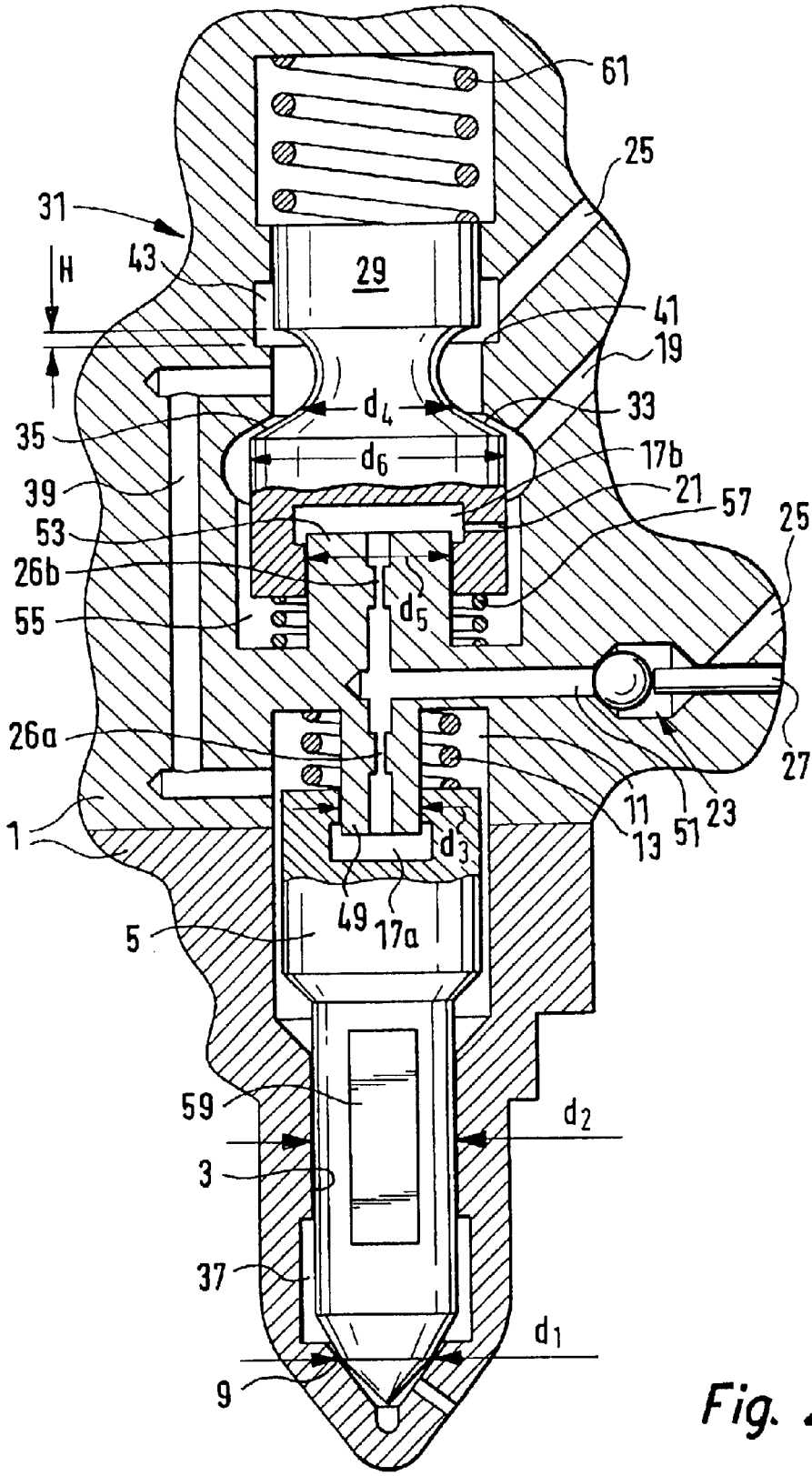
FIG. 2 shows a second exemplary embodiment of an injector of the invention.

In FIG. 2, a second exemplary embodiment of an injector of the invention is shown. Identical components are identified with the same reference numerals, and the description made of them with regard to FIG. 1 applies. In this second exemplary embodiment, the control chamber is divided into a first part 17*a* and a second part 17*b*. The first part 17*a* is embodied within the nozzle needle 5 and is defined, at least in part, by a first shoulder 49 of the housing 1. The first shoulder has a third diameter $d_3$, which in its function is equivalent to the third diameter $d_3$ of the pressure rod 7 in the exemplary embodiment of FIG. 1. The first part 17*a* of the control chamber can be made to communicate with the fuel return 25 via a first outlet throttle 26*a*, via the control valve 23 and a supply line 51.

In the valve member 29, a second part 17*b* of the control chamber is embodied, which is defined, at least in part, by a second shoulder 53 of the housing 1. Via a second outlet throttle 26*b*, the second part 17*b* of the control chamber is also in communication with the supply line 51. The fuel inlet 19, via an inlet throttle 21, supplies the second part 17*b* of the control chamber with fuel that is at high pressure. Via the second outlet throttle 26*b* and the first outlet throttle 26*a*, the first part 17*a* of the control chamber is supplied with fuel as well.

Figure 4:
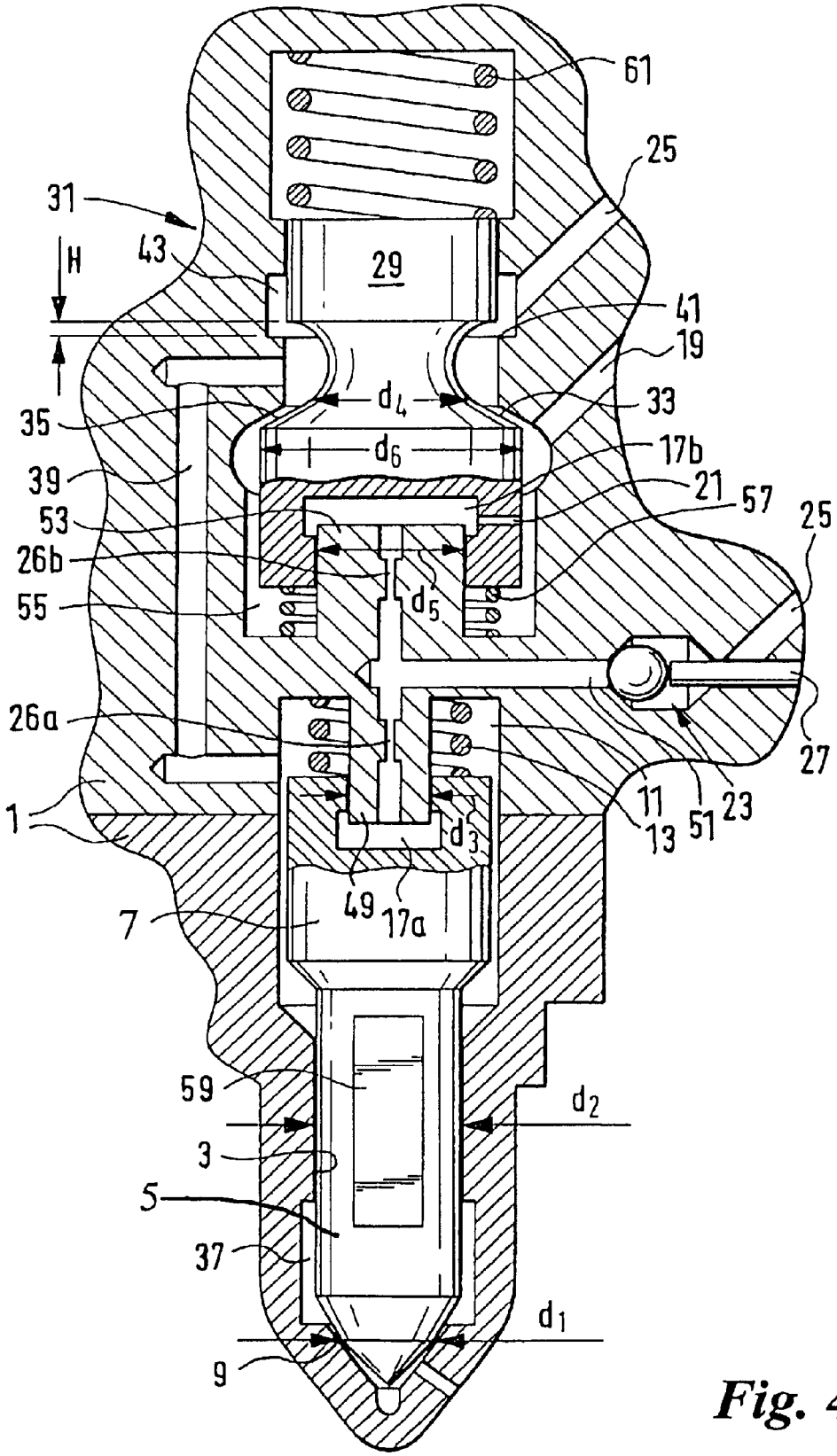
FIG. 4 shows an arrangement similar to FIG. 2, except that the pressure rod and nozzle needle are separate elements.

FIG. 4 shows structure which is similar to FIG. 2, except that, as in FIG. 1, a thrust rod 7 is provided which is separate from the nozzle needle 5.

In the housing 1 of the injector, a closing spring chamber 55 is formed, and a closing spring 57 is present in it. This closing spring 57 assures that the valve member 29 is put into the first switching position, shown in FIG. 2, if the injector is without pressure. In the first switching position, the pressure chamber 37 communicates with the fuel return 25 via flat faces 59 on the nozzle needle 5, via the nozzle spring chamber 11, and via the connecting bore 39. The communication between the pressure chamber 37 and the fuel return 25 on the one hand and the fuel inlet 19 on the other is broken, in the first switching position, by the sealing seat 33.

When the pressure in the second part 17*b* of the control chamber drops, an opening spring 61 causes the valve member 29 to lift from the sealing seat 33 and thus causes the communication to be established between the fuel inlet 19 and the pressure chamber 37. The communication with the fuel return 25 is not broken until the valve member 29 has traversed a stroke H, and thus the part of the valve member acting as a valve piston comes to overlap the control edge 41. In other words, the 3/2-way valve 31 is stroke-controlled. As soon as the hydraulic force, exerted on the nozzle needle 5 in the opening direction, in the pressure chamber 37 is greater than the oppositely oriented force in the first part 17*a* of the control chamber, the nozzle needle 5 lifts from the nozzle needle seat 9, and the injection begins. Thus the onset of the injection is pressure-controlled, with the familiar advantages thereof, such as fast opening. In this exemplary embodiment, because of the division of the control chamber into a first part 17*a* and a second part 17*b*, the total volume of the control chamber can be reduced further, so that the operating performance of the injector of the invention is improved further. Also in this exemplary embodiment, the opening of the 3/2-way valve and the opening of the nozzle needle 5 take place in chronological succession, so that the control events each proceed optimally and without being affected by one another.

Figure 3:
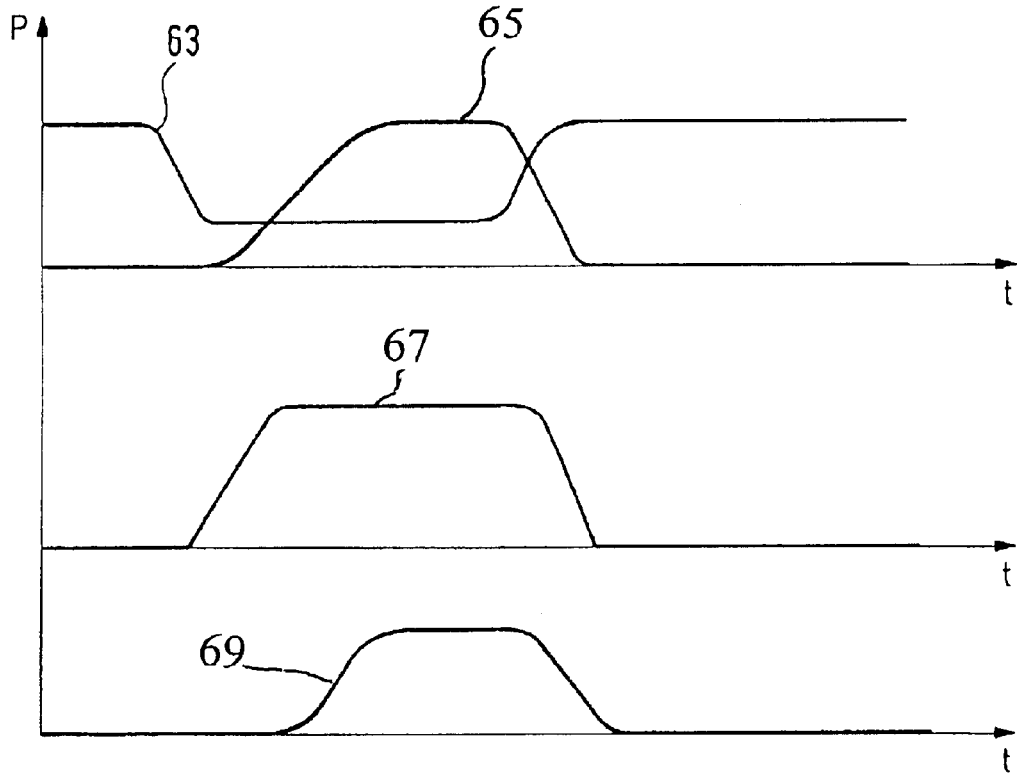
FIG. 3 shows the course over time of the pressure in the pressure chamber, of the valve member stroke, and of the nozzle needle stroke, in the form of a graph.

In FIG. 3, the course over time of an injection event is shown in the form of a graph. In the top graph, the pressure P is plotted over the time t. A first line 63 represents the course over time of the pressure in the control chamber 17. A second line 65 represents the pressure in the pressure chamber 37. This pressure is also exerted on the pressure shoulder 47 of the nozzle needle 5. In a second graph, the stroke 67 of the control valve 23 is plotted over time. In a third graph, located below it, the stroke 69 of the nozzle needle 5 is plotted over time. From this drawing and taking the three graphs one below the other together, it can be seen clearly that the nozzle needle opens under pressure control, and the control motion of the valve member 29 and the opening of the nozzle needle 5 do not occur simultaneously.

The result is the aforementioned advantages, such as good opening and closing performance of the injector, as well as its suitability for postinjections.

The foregoing relates to preferred exemplary embodiments of the invention, it being understood that other variants and embodiments thereof are possible within the spirit and scope of the invention, the latter being defined by the appended claims.

I claim:

1. An injector for a fuel injection system for internal combustion engines, the injector comprising a housing (1), a nozzle needle (5), a control chamber (17), a pressure chamber (37) defined by a pressure shoulder (47) of the nozzle needle (5), the control chamber (17) communicating hydraulically with a fuel inlet (19) via an inlet throttle (21), and a control valve (23) operable to place the control chamber (17) in communication hydraulically with a fuel return (25) via an outlet throttle (26), a 3/2-way valve (31) with a valve member (29), the 3/2-way valve (31), in a first switching position, connecting the pressure chamber (37) and the fuel return (25) hydraulically to one another, and in a second switching position, connecting the pressure chamber (37) and the fuel inlet (19) hydraulically to one another;

the 3/2-way valve (31) assuming the first or the second switching position as a function of the pressure difference between the fuel inlet (19) and the control chamber (17).

2. The injector of claim 1 wherein the control chamber (17) is defined by one end face of the valve member (29); wherein the fuel inlet (19) can be disconnected from the pressure chamber and/or the fuel return (25) by a sealing seat (33) embodied in the housing (1) and cooperating with a sealing cone (35) of the valve member (29); and wherein the diameter ($d_4$) of the sealing seat (33) is less than the diameter of the end face of the valve member (29).

3. The injector of claim 2 further comprising a pressure rod (7) between the control chamber (17) and the nozzle needle (5); wherein the control chamber (17) is defined, at least in part, by a first face end (15) of the pressure rod (7); and wherein a second face end of the pressure rod (7) rests on one face end of the nozzle needle (5).

4. The injector of claim 1 wherein in the housing (1), a control edge (41) cooperating with a portion, embodied as a valve piston, of the valve member (29) is provided; and wherein the hydraulic communication between the pressure chamber (37) and the fuel return (25) is controlled via the control edge (41).

5. The injector of claim 4 further comprising a pressure rod (7) between the control chamber (17) and the nozzle needle (5); wherein the control chamber (17) is defined, at least in part, by a first face end (15) of the pressure rod (7); and wherein a second face end of the pressure rod (7) rests on one face end of the nozzle needle (5).

6. The injector of claim 1 further comprising a pressure rod (7) between the control chamber (17) and the nozzle needle (5); wherein the control chamber (17) is defined, at least in part, by a first face end (15) of the pressure rod (7); and wherein a second face end of the pressure rod (7) rests on one face end of the nozzle needle (5).

7. The injector of claim 1 wherein a first part (17*a*) of the control chamber is provided in a pressure rod (7) disposed between the control chamber (17) and the nozzle needle (5);

and wherein one face end of the pressure rod rests on one face end of the nozzle needle (5).

8. The injector of claim 1 further comprising a nozzle spring (13) between the housing (1) and the nozzle needle (5), the nozzle spring (13) pressing the nozzle needle (5) in the direction of a nozzle needle seat (9).

9. The injector of claim 1 further comprising a closing spring (57) between the housing (1) and the valve member (29), the closing spring (57) pressing the valve member (29) in the direction of the sealing seat (33).

10. The injector of claim 1 wherein the control valve (23) is actuated by an electromagnet or a piezoelectric actuator.

11. The injector of claim 1 wherein the housing (1) is embodied in two parts.

12. The injector of claim 1 wherein the fuel injection system is a common rail injection system.

13. An injector for a fuel injection system for internal combustion engines, the injector comprising a housing (1), a nozzle needle (5), a control chamber (17), a pressure chamber (37) defined by a pressure shoulder (47) of the nozzle needle (5), the control chamber (17) communicating hydraulically with a fuel inlet (19) via an inlet throttle (21), and a control valve (23) operable to place the control chamber (17) in communication hydraulically with a fuel return (25) via an outlet throttle (26), a 3/2-way valve (31) with a valve member (29), the 3/2-way valve (31), in a first switching position, connecting the pressure chamber (37) and the fuel return (25) hydraulically to one another, and in a second switching position, connecting the pressure chamber (37) and the fuel inlet (19) hydraulically to one another;

the 3/2-way valve (31) assuming the first or the second switching position as a function of the pressure difference between the fuel inlet (19) and the control chamber (17), wherein the control chamber (17) is embodied in two parts including a first part (17*a*) embodied within the nozzle needle (5) and a second part (17*b*) embodied within the valve member (29); wherein the first part (17*a*) of the control chamber (17) is defined, at least in part, by a first shoulder (49) in the housing (1); and wherein the second part (17*b*) of the control chamber (17) is defined, at least in part, by a second shoulder (53) in the housing (1).

14. The injector of claim 13 wherein the second part (17*b*) of the control chamber (17) communicates hydraulically with the fuel inlet (19) via an inlet throttle (21).

15. The injector of claim 14 wherein the first part (17*a*) and the second part (17*b*) of the control chamber (17) can be made to communicate with the fuel return (25), each via a respective outlet throttle (26).

16. The injector of claim 14 wherein the first part (17*a*) and the second part (17*b*) of the control chamber (17) communicate hydraulically with one another.

17. The injector of claim 13 wherein the first part (17*a*) and the second part (17*b*) of the control chamber (17) can be made to communicate with the fuel return (25), each via a respective outlet throttle (26).

18. The injector of claim 17 wherein the first part (17*a*) and the second part (17*b*) of the control chamber (17) communicate hydraulically with one another.

19. The injector of claim 13 wherein the first part (17*a*) and the second part (17*b*) of the control chamber (17) communicate hydraulically with one another.

20. An injector for a fuel injection system for internal combustion engines, the injector comprising a housing (1), a nozzle needle (5), a control chamber (17), a pressure chamber (37) defined by a pressure shoulder (47) of the nozzle needle (5), the control chamber (17) communicating hydraulically with a fuel inlet (19) via an inlet throttle (21), and a control valve (23) operable to place the control chamber (17) in communication hydraulically with a fuel return (25) via an outlet throttle (26), a 3/2-way valve (31) with a valve member (29), the 3/2-way valve (31), in a first switching position, connecting the pressure chamber (37) and the fuel return (25) hydraulically to one another, and in a second switching position, connecting the pressure chamber (37) and the fuel inlet (19) hydraulically to one another;

the 3/2-way valve (31) assuming the first or the second switching position as a function of the pressure difference between the fuel inlet (19) and the control chamber (17), wherein the control chamber is embodied in two parts including a first part (17*a*) embodied within the nozzle needle (5) and a second part (17*b*) embodied within the valve member (29).

* * * * *

UNITED STATES PATENT AND TRADEMARK OFFICE

CERTIFICATE OF CORRECTION

PATENT NO. : 6,837,450 B2
DATED : January 4, 2005
INVENTOR(S) : Friedrich Boecking It is certified that error appears in the above-identified patent and that said Letters Patent is hereby corrected as shown below:

Title page,
Item [56], please add the following references:

-- (56) References Cited

U.S. PATENT DOCUMENTS

| | |
|---|---|
| 2002/0020765 A1 | 2/2002 Boecking |
| 2002/0109015 A1 | 8/2002 Boecking |

FOREIGN PATENTS

| | |
|---|---|
| DE 199 63 367 A1 | 7/2001 |
| DE 297 17 649 U1 | 1/1998 |
| WO 02/36958 A1 | 5/2002 |
| WO 00/17506 A1 | 3/2000 |
| EP 1 036 931 A2 | 9/2000 |
| JP 1-1280588 A | 10/1999 |
| EP 1 236 883 A2 | 9/2002 --. |

Signed and Sealed this

Twenty-third Day of August, 2005

JON W. DUDAS
*Director of the United States Patent and Trademark Office*